US009127536B2

(12) United States Patent
Hill

(10) Patent No.: US 9,127,536 B2
(45) Date of Patent: Sep. 8, 2015

(54) TOOL FOR USE IN WELL MONITORING

(75) Inventor: David R Hill, Trinidad, CO (US)

(73) Assignee: RESERVOIR MANAGEMENT SERVICES, LLC, Bakersfield, CA (US)

( * ) Notice: Subject to any disclaimer, the term of this patent is extended or adjusted under 35 U.S.C. 154(b) by 405 days.

(21) Appl. No.: 13/604,216

(22) Filed: Sep. 5, 2012

(65) Prior Publication Data

US 2012/0325456 A1 Dec. 27, 2012

Related U.S. Application Data

(63) Continuation-in-part of application No. 12/317,776, filed on Dec. 29, 2008, now Pat. No. 8,281,853.

(51) Int. Cl.

| | |
|---|---|
| ***E21B 43/12*** | (2006.01) |
| ***E21B 47/04*** | (2012.01) |
| *E21B 47/00* | (2012.01) |

(52) U.S. Cl.

CPC ..... *E21B 43/127* (2013.01); *E21B 47/042* (2013.01); *E21B 43/121* (2013.01); *E21B 47/0007* (2013.01)

(58) Field of Classification Search

CPC . E21B 47/042; E21B 47/0007; E21B 43/121; E21B 43/127

See application file for complete search history.

(56) References Cited

U.S. PATENT DOCUMENTS

| | | | | |
|---|---|---|---|---|
| 2,047,974 | A * | 7/1936 | Lehr et al. | 367/81 |
| 3,316,997 | A * | 5/1967 | McCoy | 73/290 V |
| 4,125,163 | A * | 11/1978 | Fitzpatrick | 166/250.03 |
| 4,934,186 | A * | 6/1990 | McCoy | 73/152.58 |
| 5,117,399 | A * | 5/1992 | McCoy et al. | 367/99 |
| 5,200,894 | A * | 4/1993 | McCoy et al. | 702/6 |
| 5,715,890 | A * | 2/1998 | Nolen | 166/250.03 |
| 6,705,397 | B2 * | 3/2004 | Hershberger | 166/250.03 |
| 7,314,349 | B2 * | 1/2008 | Mills | 417/42 |
| 2012/0227480 | A1 * | 9/2012 | Nguyen-Thuyet et al. | 73/152.02 |

* cited by examiner

*Primary Examiner* — Nicole Coy

(74) *Attorney, Agent, or Firm* — James M. Duncan, Esq.; Klein DeNatale Goldner

(57) ABSTRACT

A system for matching the hydrocarbon reservoir inflow with the outflow of an artificial lift system utilizes an apparatus which makes real time fluid level determinations and inputs the observed fluid levels into a processor which controls the speed of a motor which operates a subsurface pump, so as to increase hydrocarbon production. The apparatus which makes real time fluid determinations is installed such that a gas emission port and a pressure wave receiving port are placed within the tubing-casing annulus.

18 Claims, 17 Drawing Sheets

TOOL FOR USE IN WELL MONITORING

CROSS-REFERENCE TO RELATED APPLICATION

This is a continuation-in-part application of U.S. patent application Ser. No. 12/317,776 filed 29 Dec. 2008, and claims priority to the filing date thereof for all commonly disclosed information.

BACKGROUND OF THE INVENTION

1. Field of the Invention

The present invention relates to producing a liquid from a well such as a gas well, an oil well, or water well while maintaining the fluid level in the tubing-casing annulus at a desired level through the interaction of a real-time fluid level detection device with a variable frequency controller connected to an electrical motor operating a subsurface pump. The integration of a real-time fluid level detection device together with a variable frequency controller allows the optimization of well bore inflow with the well outflow provided by the artificial lift system. As an added benefit, the present invention provides for the rapid and relatively easy determination of the fluid level in the tubing-casing annulus, as well as providing a history of the fluid levels and performance history of the artificial lift equipment. The system may be utilized to monitor and record the observed fluid flow, gas flow, the casing pressure, and the tubing pressure. The system may also determine the best fluid level for maximum inflow given the existing well mechanical condition and the reservoir dynamics, such as influence from injection wells or other producing wells.

2. Description of Practices in the Art

It is known that fluids are replenished into a particular well bore at different rates even in the same formation or well field. Such replenishment is impacted by, among other things, the section of reservoir exposed to perforations or slots, any formation damage adjacent to the well bore, and/or the extent of reservoir heterogeneities adjacent to the well bore. Moreover, fluid replenishment into a particular well bore may change over time as a result of changes in reservoir properties resulting from cumulative production, stimulation or reservoir management practices. When a fluid reservoir is initially produced, there may be sufficient reservoir energy to produce the fluids to the ground surface, i.e., the pressure of the fluid reservoir is greater than the hydrostatic pressure exerted by a fluid column which extends from the ground surface to the depth of the reservoir. However, once the reservoir energy depletes to where the reservoir pressure is less than the hydrostatic pressure of the fluid column, some form of artificial lift system is required to bring the reservoir fluids to the ground surface. Such artificial lift systems may include subsurface pumps which are typically installed at the depth of the producing reservoir.

One commonly known artificial lift system utilizes a plurality of rods connected in an end-to-end configuration forming a "rod string." The rod string is set within a plurality of tubing joints which are likewise connected in an end-to-end configuration forming the "tubing string," with the reservoir fluids primarily produced up the tubing string. The rod string is utilized to operate a pump set at the bottom of the tubing string. The most commonly used subsurface pump has a plunger which reciprocates up and down within a barrel, where the plunger is connected to the rod string and the rod string is reciprocated by a pumping unit set at the ground surface. Another type of subsurface pump, a progressive cavity pump, has a rotor which is rotated within a stator by the rod string, where the rod string is rotated at the ground surface by an electrical motor coupled to a gear reducer. Electric submersible pumps are also used, where the motor is located downhole and coupled directly to a centrifugal pump. In these installations, no rod string is required. However, the capacities of each of these artificial lift systems—reciprocating rod pumps, progressive cavity pumps, and downhole centrifugal pumps—is capable of being adjusted by utilizing a variable frequency drive to change the speed of the electrical motor operating the system.

With each subsurface pumping system, a dynamic equilibrium is reached where the inflow rate of the reservoir and the outflow rate generated by the artificial lift system are essentially equivalent, except for gas produced through the casing-tubing annulus. However, the inflow rate from the reservoir into the well bore depends upon any backpressure maintained on the reservoir through the well bore. Such backpressure may be imposed by the surface production equipment into which the well produces. Backpressure is also imposed by any standing fluid level within the well bore in the tubing-casing annulus. Ideally, backpressure and the fluid level within the tubing-casing annulus are maintained at a minimum to maximize the pressure differential from the reservoir into the well bore and thus maximize fluid flow into the well bore. However, achieving this maximum inflow requires a corresponding matching outflow to reach a dynamic equilibrium. In other words, to achieve maximum production from a well, the well outflow rate generated by the artificial lift system must match the maximum inflow rate produced from the reservoir to minimize the backpressure exerted by the fluid level.

The preceding discussion suggests that the subsurface pump should be run constantly and/or at a high capacity to keep the level in the well bore as low as possible thus maximizing production. However, this option may be less than ideal because if the outflow produced by the artificial lift equipment exceeds the inflow, several negative results may occur. First, running the pump constantly or at too great a speed may be inefficient because, some of the time, the well may be "pumped off" leaving little fluid in the well bore to be pumped, resulting in wasted energy. Second, running pumping equipment when a well is in a pumped off condition can damage the equipment, resulting in costly repairs. Third, paraffin build up is more pronounced when a well is allowed to pump dry. In a pumped off condition gases are drawn into the well bore, which expand and cool. As the gases cool, paraffin build up is promoted as the hydrocarbons begin plate out on the surfaces of the well bore.

Achieving equilibrium between inflow and outflow is further complicated by changing conditions within the reservoir, which result in changes in inflow performance. Such changes may result from, among other things, the initiation or suspension of a reservoir pressure maintenance program utilizing either gas or water injection, stimulating the well to remove reservoir damage near the well bore, or stimulating injection wells to increase injection rates. The reservoir conditions may also be impacted by the addition of new wells producing from the reservoir or changing production rates in existing wells. Thus, matching inflow performance of the reservoir with the outflow of the artificial lift system can present a moving target and an artificial lift system which maintains a constant outflow is not a preferred solution for a well subject to changes in its inflow performance.

A variety of methods are known for adjusting the outflow performance of an artificial lift system. Systems which utilize reciprocating rod pumps may have adjustments made to the outflow performance by changing the speed of rod reciprocation, changing the length of the pump stroke, or changing the diameter of the subsurface pump. Changing pumping speed and pump stroke for rod pumped wells usually can be accomplished by making adjustments in surface equipment, however changing the pump diameter requires pulling the rod string, pump, and often the tubing string. Changing the speed of rod reciprocation can be done by causing the surface pumping unit to run faster by either changing the sheave size between the prime mover and gear box, or by changing the operational speed of the pumping unit motor. Changing the sheave size requires the shutting down of the pumping unit and can be an involved process requiring a construction crew.

Changing the operational speed of the motor may be accomplished through the use of a variable speed drive unit, or variable frequency drive ("VFD"). If a VFD is combined with a processing unit, various input parameters, including observed fluid levels, may be utilized to arrive at a pumping speed, and thus a particular outflow capacity, which is in dynamic equilibrium with the reservoir inflow performance. Such systems may be used not only with reciprocating rod pumps, but also with rod-operated progressive cavity pumps and downhole submersible pumps.

U.S. Pat. No. 6,085,836, invented by the present inventors, proposed an initial solution to the problem of reaching dynamic equilibrium between reservoir inflow performance and the outflow performance of the artificial lift equipment. The '836 patent is incorporated herein by reference. The '836 patent discloses a method of determining the well fluid level for purposes of adjusting the subsurface pumping time, including controlling pumping time with timers. It is known to use timers to control the pump duty cycle. A timer may be programmed to run the well nearly perfectly if one could determine the duration of the on cycle and off cycle which maintains a dynamic equilibrium between the inflow to the well bore and the outflow generated by the artificial lift equipment.

If real time fluid level information can be obtained, deciding when or how fast to run the pump is relatively straightforward and production can be optimized. Real time fluid level determinations, particularly for deep well systems, have been realized by the implementation of downhole instrumentation such as load cells, transducers or similar devices which acquire downhole pressures (thus fluid levels) and transmit the information to the surface via various means. Unfortunately, these real time downhole systems have been costly and complex to install, unreliable in operation, and costly to repair or service. Although the implementation details will not be discussed here, it is worth noting that these systems, when operating correctly, have proven that significant gains in well production are available when control strategies applying real time fluid level measurement are utilized.

As an alternative to systems which measure downhole pressure, are those systems which utilize acoustic energy to ascertain the depth of the fluid level by generating an acoustic wave at the surface and detecting the return signal to calculate the depth to fluid. One such system uses a one-shot measurement. The one-shot measurement will use a sonic event, such as firing a shotgun shell, to generate the acoustic signal. Another system utilizes charges from a nitrogen tank to generate sonic events. However, in either of the foregoing systems the production of the well must be shut down before initiating the sonic event and monitoring the corresponding return signals.

SUMMARY OF THE INVENTION

In contrast to the foregoing systems, the present invention does not require downhole instrumentation and thus does not present the complexities in installation and maintenance presented by such systems. With respect to the systems which utilize acoustic waves at the surface, the present invention will permit continuous operation of the well as the sonic events are generated, the data collected, the well conditions read out, and the changes in pumping implemented. Moreover, the system of the present invention may utilize produced fluids from the well to generate the acoustic signal, thus avoiding the need to replenish the material and the cost such material which are otherwise utilized, such as nitrogen or gunpowder. The present invention does not require opening of the well to the atmosphere as typically required for surface deployed units. The real time fluid level determinations provided by embodiments of the present invention in combination with the variable frequency control of the motor operating the subsurface pump provides a production system which accomplishes the optimal production rate, where the reservoir inflow may be balanced with the artificial lift outflow with the fluid level maintained at a level which provides maximum draw down into the wellbore.

The real time fluid level detection means of the present invention has a conduit which provides fluid communication between the tubing-casing annulus and a compressor. A pressure transducer is in fluid communication with the compressor and configured such that, when used in combination with a valve and the compressor, releases a charge of compressed gas into the tubing-casing annulus through a gas emission tubing. The real time fluid level detection means also has a gas receiving tube which provides fluid communication between the tubing-casing annulus and a pressure measurement device, where the pressure measurement device has means for ascertaining a return signal from the charge of compressed gas, wherein said return signal enables a processor to determine the well fluid level. The real time fluid level detection means is automatically and periodically activated to provide a continuing determination of the fluid level in the tubing-casing annulus, thus providing an indication of the reservoir inflow performance.

Used in combination with the real time fluid level detection means, an artificial lift system has an outflow capacity which may be adjusted in accord with the observed real time fluid level measurements, which allows the inflow and outflow performance of the well to be optimized for producing the well at a flow rate which is efficient, reduces wear in the artificial lift system, and which may be coordinated on a field wide basis with other artificial lift units for effective reservoir management. The adjustment is achieved by utilizing a variable frequency drive unit with the electrical motor which operates the subsurface pump. The variable frequency drive unit has a user interface which allows for adjusting set points for depth to fluid level, or which allows for changing the production rate with a manual control. The user interface further provides various reservoir management tools, such as historical analysis of fluid levels, production rates, and surface pressures for both the tubing and casing. When employed on a field wide basis, the data may be utilized to ascertain, among other things, the effectiveness of well stimulation programs, pressure maintenance activities, and well spacing practices. When analyzed together with well maintenance records, the information may also be utilized for analyzing preventative maintenance, scheduling pump changes, and well diagnostics.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DETAILED DESCRIPTION OF THE INVENTION

Fluid Level Determination Mechanism and Installment Tool

The fluid level determination mechanism of the present invention provides a gas emitting tubing 256 and a gas receiving tubing 356 directly into the tubing-casing annulus 276 of a well. In one embodiment, the fluid level determination mechanism utilizes produced gas for generating an energy pulse and comprises means for detecting a return signal. Utilizing the elapsed time between the initial pulse and the detection of the return signal, a processor calculates the fluid level in the tubing-casing annulus 276. This cycle may be repeated as desired, up to three times per minute, to monitor the relationship between the reservoir inflow and the outflow produced by the artificial lift equipment or, without operating the artificial lift equipment, perform various diagnostic tests including interference testing or to conduct pressure build-up tests.

Figure 1:
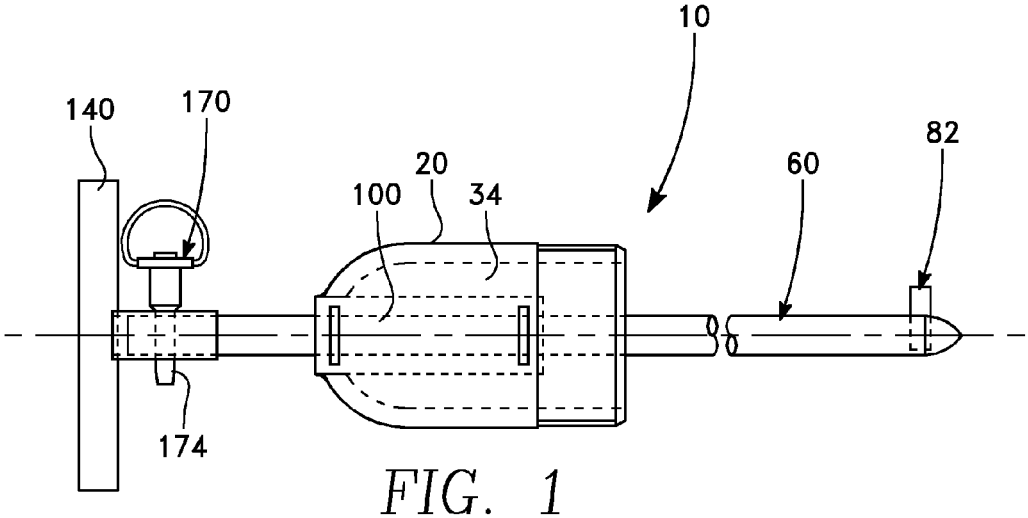
FIG. 1 shows an insert tool which may be utilized for manipulating the gas emission tubing and gas receiving tubing into position within a wellhead of a well.

FIG. 1 depicts an embodiment of an insertion tool 10 which may be used for placing components of the fluid level determination mechanism into place within a wellhead 258. The insertion tool 10 allows the insertion and retraction of these components adjacent or into the tubing-casing annulus 276 while continuing to maintain pressure control of the well. As discussed in greater detail below, various components of the fluid level determination mechanism are set within a carrier tray 180 which slides within a housing 202 which is made up to second outlet 306 of the wellhead 258. The carrier tray 180 and housing 202 may be attached as a unit to the second outlet 306 and the carrier tray manipulated forward from its stored position in the housing into an operating position within the wellhead by pushing the tray forward with the insertion tool 10. Likewise, when it is desired to retract the carrier tray 180 completely into the housing 202, the insertion tool 10 is re-inserted and its tip locks on to a portion of the carrier tray. The insertion tool 10 is retracted, pulling the carrier tray 180 back into the housing 202.

The insertion tool 10 comprises a bell 20 having an interior chamber 34 which extends from rear opening 38 through to forward opening 28, which is defined by exterior wall which has external threading 24. A further feature of the insertion tool 10 is shaft 60. The shaft 60 should be formed of a similar metal to bell 20 to reduce the potential for static discharge.

Again with reference to FIG. 1, an insert member 100 is fixed within the bell 20. The insert member 100 is also of a similar metal to the bell 20. When in use, the insert member 100 permits passage of the shaft 60 through the rear opening 38 and out of the forward opening 28.

Figure 4:
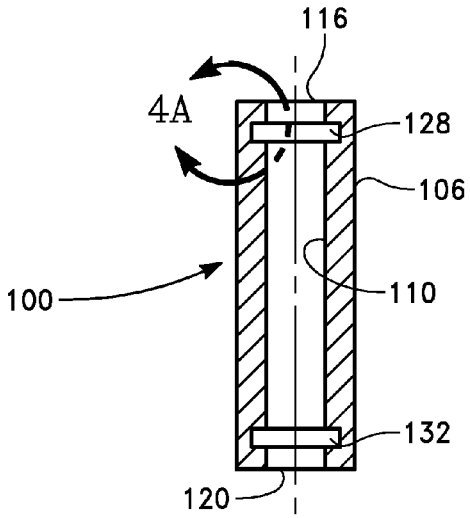
FIG. 4 is a partial sectional view according to FIG. 2.
Figure 4A:
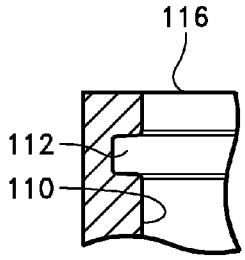
FIG. 4*a* is a partial view according to FIG. 4.
Figure 5:
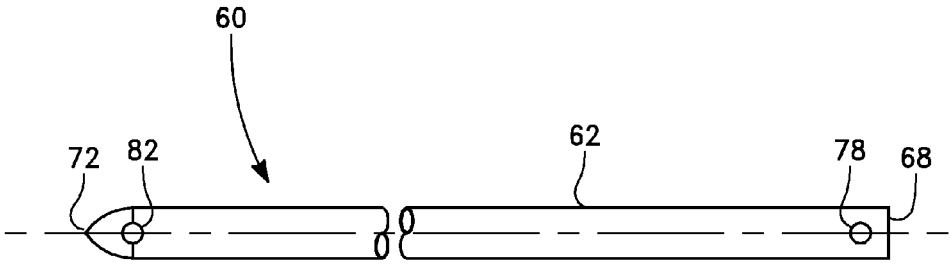
FIG. 5 is a partial view of an aspect of the invention according to FIG. 1.

Insert member 100 has an outer wall 106 and an inner wall 110. As seen in FIGS. 4 and 4A, there are bushing recesses 112 located within the inner wall 110 at approximately the opposite ends of insert member 100.

The insert member 100 has a first opening 116 at one end and a second opening 120 at the other end, where fluid communication is provided between the first opening and the second opening. The insert member 100 has an inner surface 110.

Figure 2:
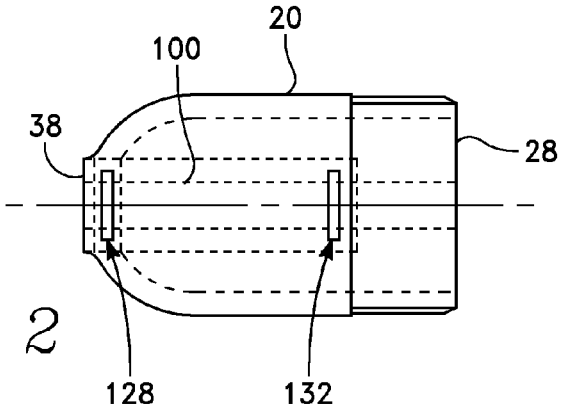
FIG. 2 is a partial view according to FIG. 1.
Figure 3:
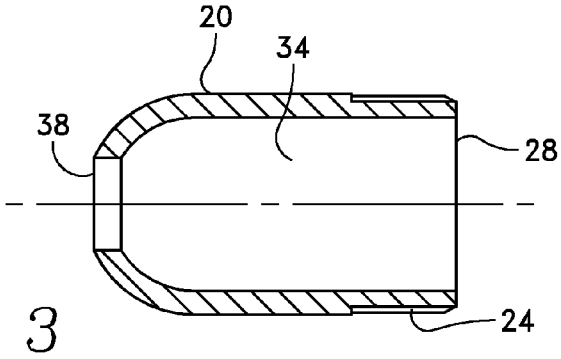
FIG. 3 is a cutaway view taken according to FIG. 2.

As seen in FIG. 2, a pair of insert bushings 128 and 132 may be disposed within the bushing recesses 112 in insert member 100. Insert bushings 128 and 132 are circular in design and are fastened or fixed to the insertion member 100. When in use, the insert bushings 128, 132 serve to guide shaft 60 through the rear opening 38 so that the insertion tool shaft 60 may exit from the forward opening 28.

Figure 7:
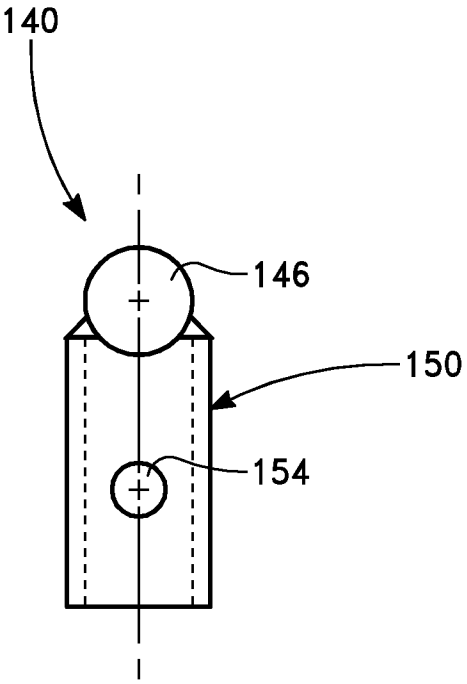
FIG. 7 is a side view according to FIG. 6.
Figure 6:
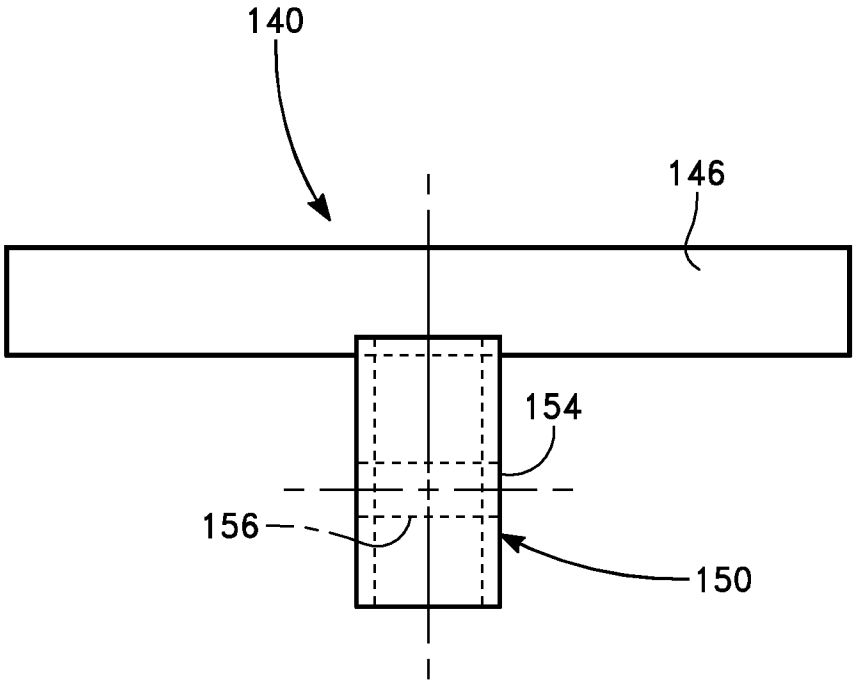
FIG. 6 is a partial view of an aspect of the invention according of FIG. 1.

With further reference to FIG. 1, the insertion tool may comprise a detachable handle 140, which is attached to one end of shaft 60. The detachable handle 140 is shown in greater detail in FIGS. 6-7. Detachable handle 140 comprises a handle gripping region 146 and an attachment member 150. The handle gripping region 146 and the attachment member 150 may be permanently joined together or be configured as separate components. The attachment member 150 has an aperture 154 defined by walls 156. As shown in FIG. 1, locking pin 170 comprising insertion member 174 may be utilized to lock the detachable handle 140 to the tool shaft 60 by inserting insertion member 174 through aperture 154 of the detachable handle and through aperture 78 in the shaft 60.

The insertion tool shaft 60 is largely comprised of a cylindrical tube 62. At one end of the cylindrical tube 62 is first end 68 and at the opposite end of the cylindrical tube 62 is second end 72. First end 68 is a circular surface defined by a generally uniform radius while second end 72 comprises a pointed surface to permit insertion of the shaft 60 through the insert member 100 and into a receiving receptacle, such as a nipple extending from a wellhead. Cylindrical tube 62 comprises a projection 82 located proximate to second end 72. Projection 82 facilitates insertion of communication equipment into wellhead 258.

Figure 8:
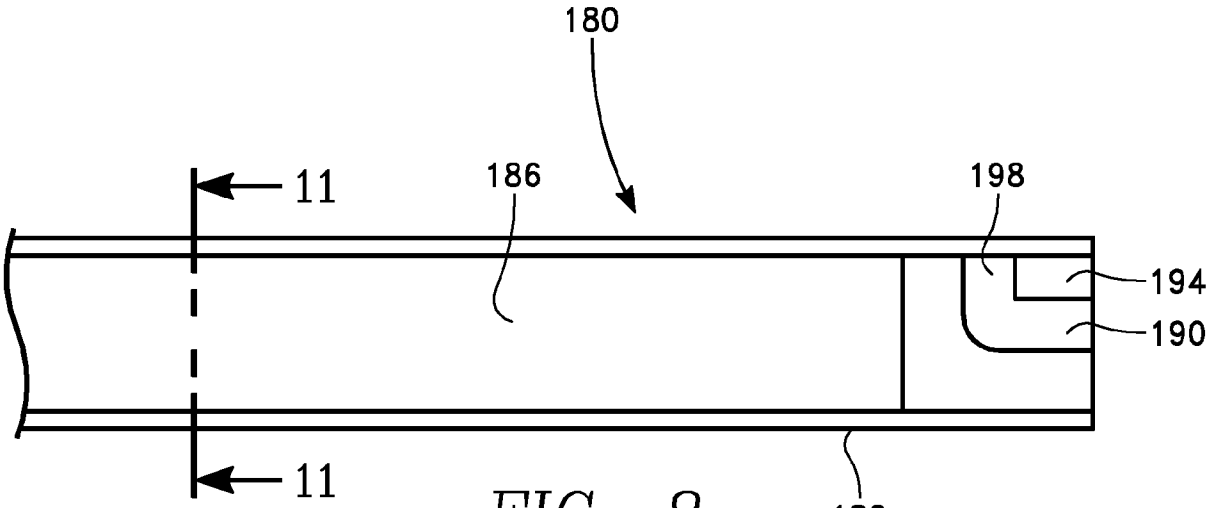
FIG. 8 is a partial plan view of a further aspect of the invention.
Figure 10:
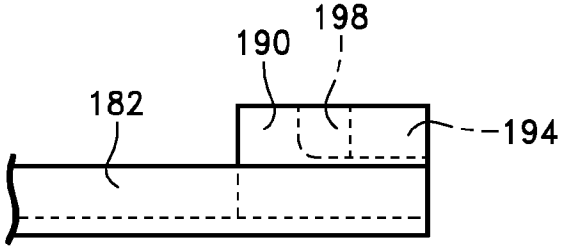
FIG. 10 is a side view taken according to FIG. 8.
Figure 9:
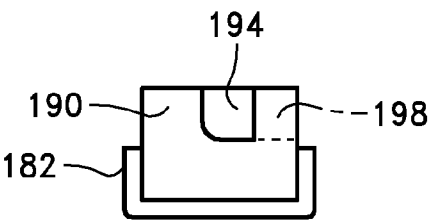
FIG. 9 is a frontal view according to FIG. 8.
Figure 11:
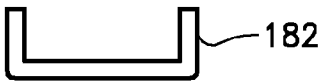
FIG. 11 is a sectional view taken along line 11-11 in FIG. 8.
Figure 16:
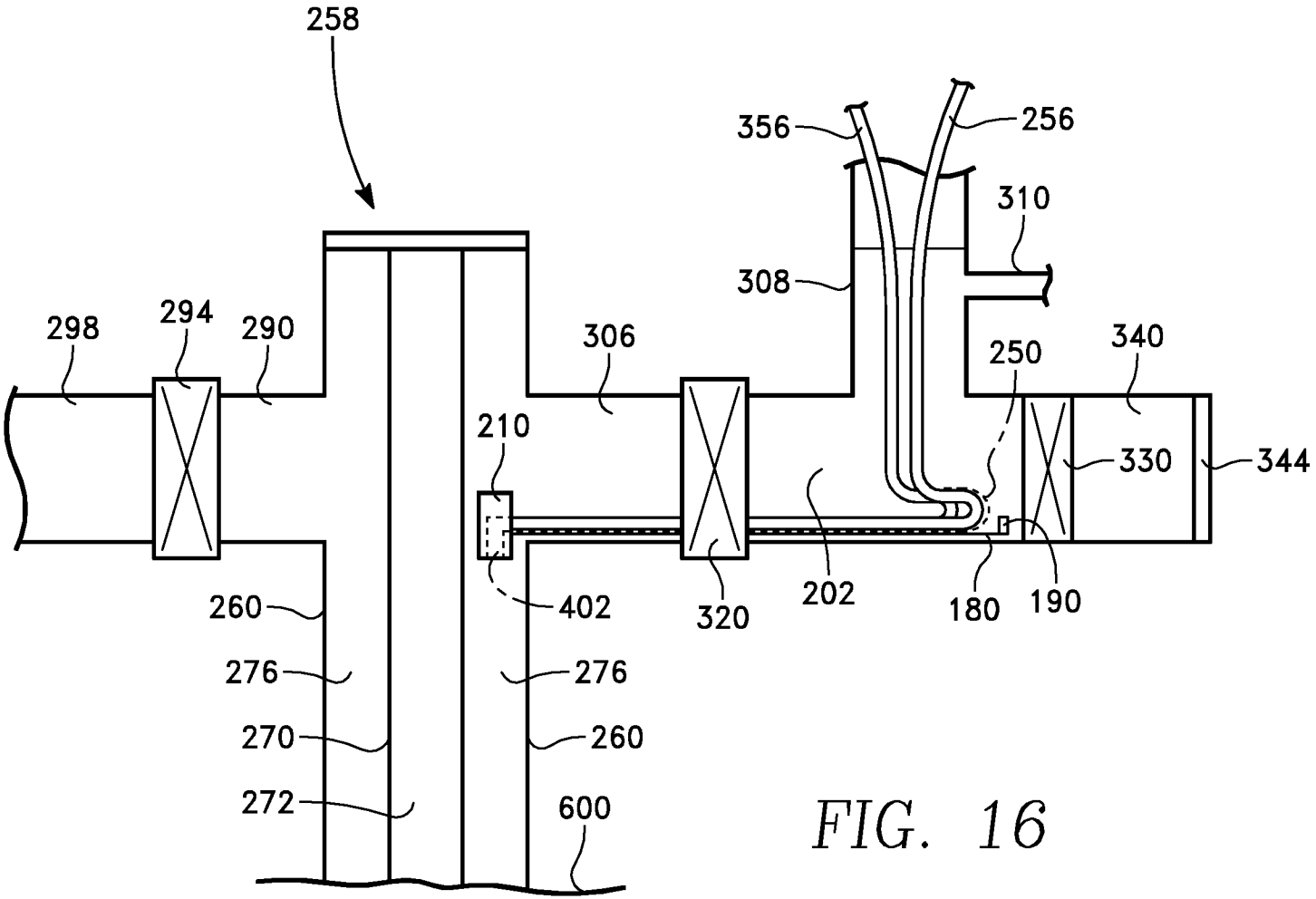
FIG. 16 is a partial view of a wellhead with various aspects of the present invention.
Figure 17:
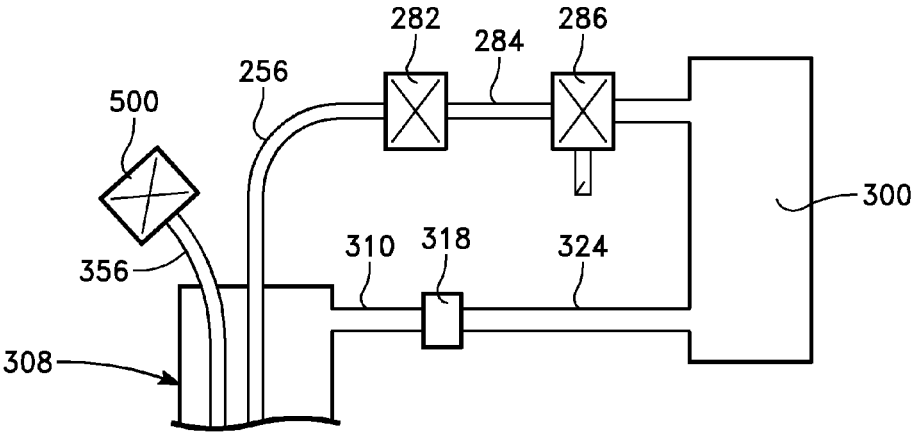
FIG. 17 is a further partial view of a wellhead with various aspects of the present invention.

FIG. 8 depicts an embodiment of carrier tray 180. As shown in FIGS. 8 and 11, carrier tray 180 has sidewall 182 on each side which define channel 186 which extends along the long axis of the carrier tray. Carrier tray 180 has a receiving piece 190 located at one end thereof. As shown in FIGS. 8-10, receiving piece 190 comprises a first channel 194, which may make a right angle turn defined in part by second channel 198. As shown in FIGS. 16-17, this right angle turn is utilized to direct gas emission tubing 256 and gas receiving tubing 356 respectively to compressor valve 282 and pressure measurement device 500.

Figure 12:
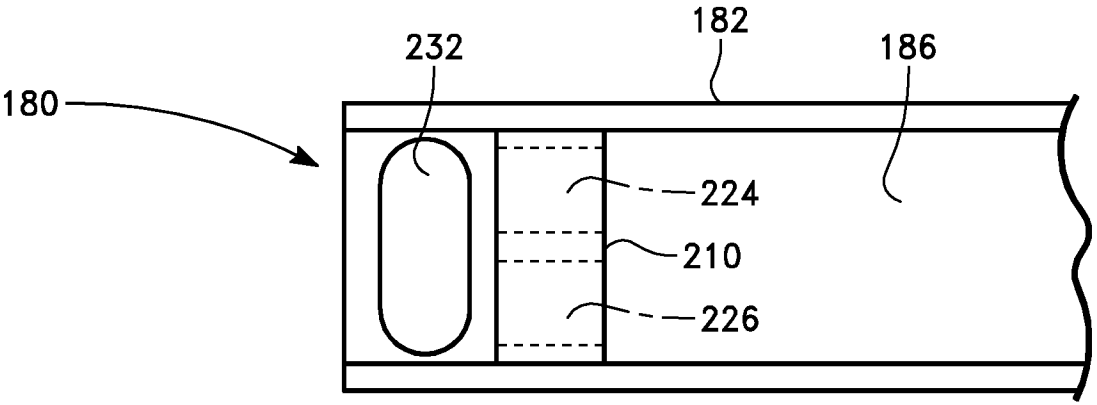
FIG. 12 is a continuation of FIG. 8, showing a partial plan view of a further aspect of the invention.
Figure 13:
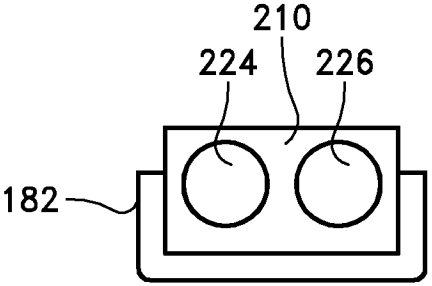
FIG. 13 is a frontal view according to FIG. 12.
Figure 14:
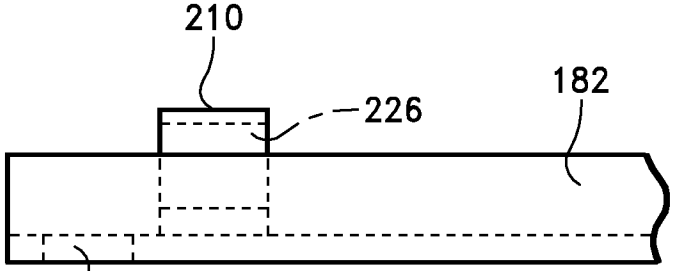
FIG. 14 is a side view according to FIG. 12.
Figure 18:
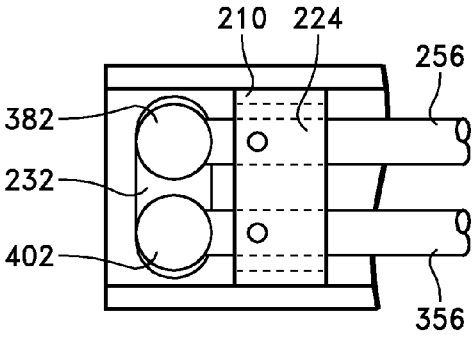
FIG. 18 is a bottom view of an aspect of the invention according to FIG. 16.
Figure 19:
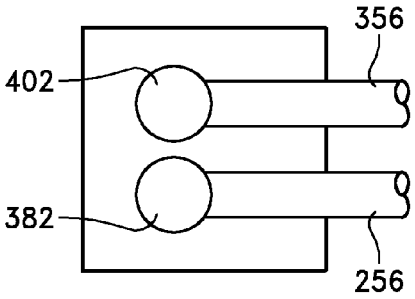
FIG. 19 is a top view of an aspect of the invention according to FIG. 16.

Referring now to FIGS. 12-14, the second end of carrier tray 180 is described. A locking mechanism 210 is disposed at the end of the carrier tray 180 opposite from receiving piece 190. A first channel 224 and a second channel 226 extend through locking mechanism 210. First channel 224 and second channel 226 are aligned along the long axis of the carrier tray 180. The second end of the carrier tray 180 further comprises an opening 232, through which gas injection port 382 and receiving port 402 are disposed as best shown in FIG. 18. When carrier tray 180 is placed within an operating position in wellhead 258 gas injection port 382 and receiving port 402 will be positioned in the tubing-casing annulus 276, each having an opening positioned in a downhole orientation.

Figure 15:
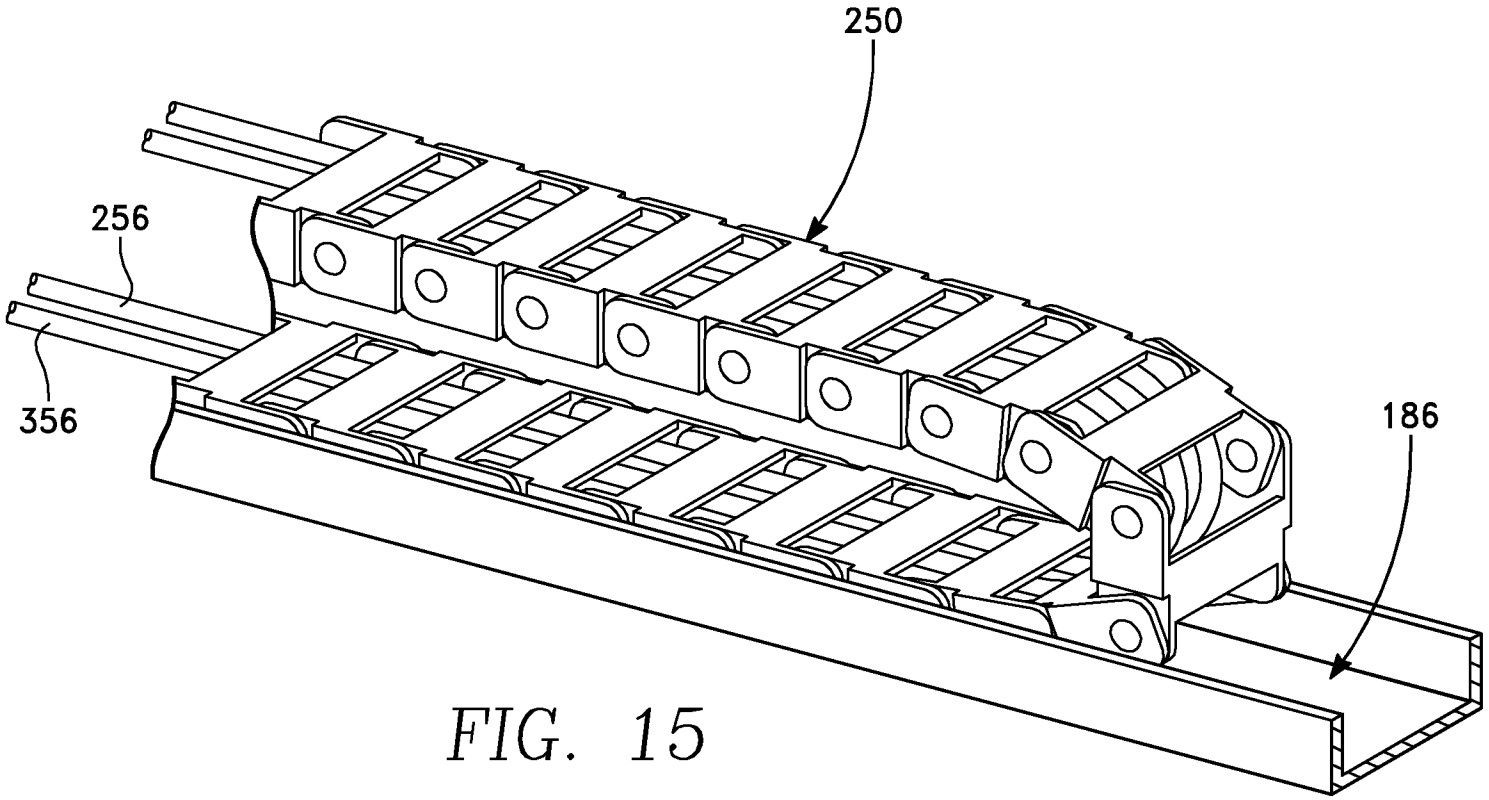
FIG. 15 is a perspective view of a further aspect of the invention.

FIG. 15 provides a perspective view of a portion of an embodiment of carrier tray 180 showing portions of gas emission tubing 256 and gas receiving tubing 356 disposed within a carrier member 250. Carrier member 250 is configured to fit within a channel 186 of carrier tray 180. The carrier member 250 permits gas injection port 382 at the terminus of gas emission tubing 256 and receiving port 402 at the terminus of gas receiving tubing 356 to be positioned within the wellhead 258 in the proper orientation with respect to the tubing-casing annulus 276, while the opposite ends of the gas emission tubing 256 and the gas receiving tubing 356 are connected to components within cover 204 as schematically depicted in FIG. 17. It is to be appreciated that carrier member 250 comprises a plurality of linked components which are flexible and the position indicated within FIG. 15 is one possible positioning of the carrier member. Gas emission tubing 256 and gas receiving tubing 356 are likewise flexible and may be flexed in a manner corresponding with that of carrier member 250, while the carrier member guides and protects the gas emission tubing and the gas receiving tubing as the carrier tray 180 is shifted within housing 202 and wellhead 258.

FIG. 16 schematically depicts the configuration of the gas emission tubing 256 and gas receiving tubing 356 in relation to wellhead 258, take-off conduit 308 and housing 202. Wellhead 258 provides a means of controlling flow from the well, which is lined with casing 260, which is typically but not necessarily landed within the wellhead as understood by those knowledgeable in the art. Suspended from wellhead 258 is a tubing string 270 through which reservoir fluids are produced to the surface. In wells with insufficient reservoir pressure to flow to the surface, oil and associated fluids are primarily produced by artificial lift mechanisms through the interior 272 of tubing string 270. In oil wells, gas which breaks out of solution within the wellbore is typically produced within the tubing-casing annulus 276.

FIG. 17 schematically shows how gas emission tubing 256 and the gas receiving tubing 356 are connected to the external components of the fluid level measuring apparatus. The gas emission tubing 256 is connected to compressor valve 282 which is connected to pressure transducer 286 by a conduit 284 or via flow channels through the various components, such as tank 288 depicted in FIG. 24. Pressure transducer 286 controls the pressure of a sample of gas to be injected into well annulus 276 through gas emission tubing 256. The pressure transducer 286 is in fluid communication with a compressor 300 or with a pressurized source of gas, such as bottled nitrogen. When compressor 300 is utilized, the system may utilize produced gas from the well as described below.

The wellhead configuration for an embodiment of the invention may be set up in the following described manner. A first outlet 290 may extend from one side of the wellhead 258, with a valve 294 attached to provide access to annulus 276 for receiving production from the well or for introducing fluids into the annulus, such as kill fluid. Valve 294 is connected to production line 298 which may transport produced fluids to a desired facility, such as a metering station, gas separator, tank farm or pipeline.

Figure 24:
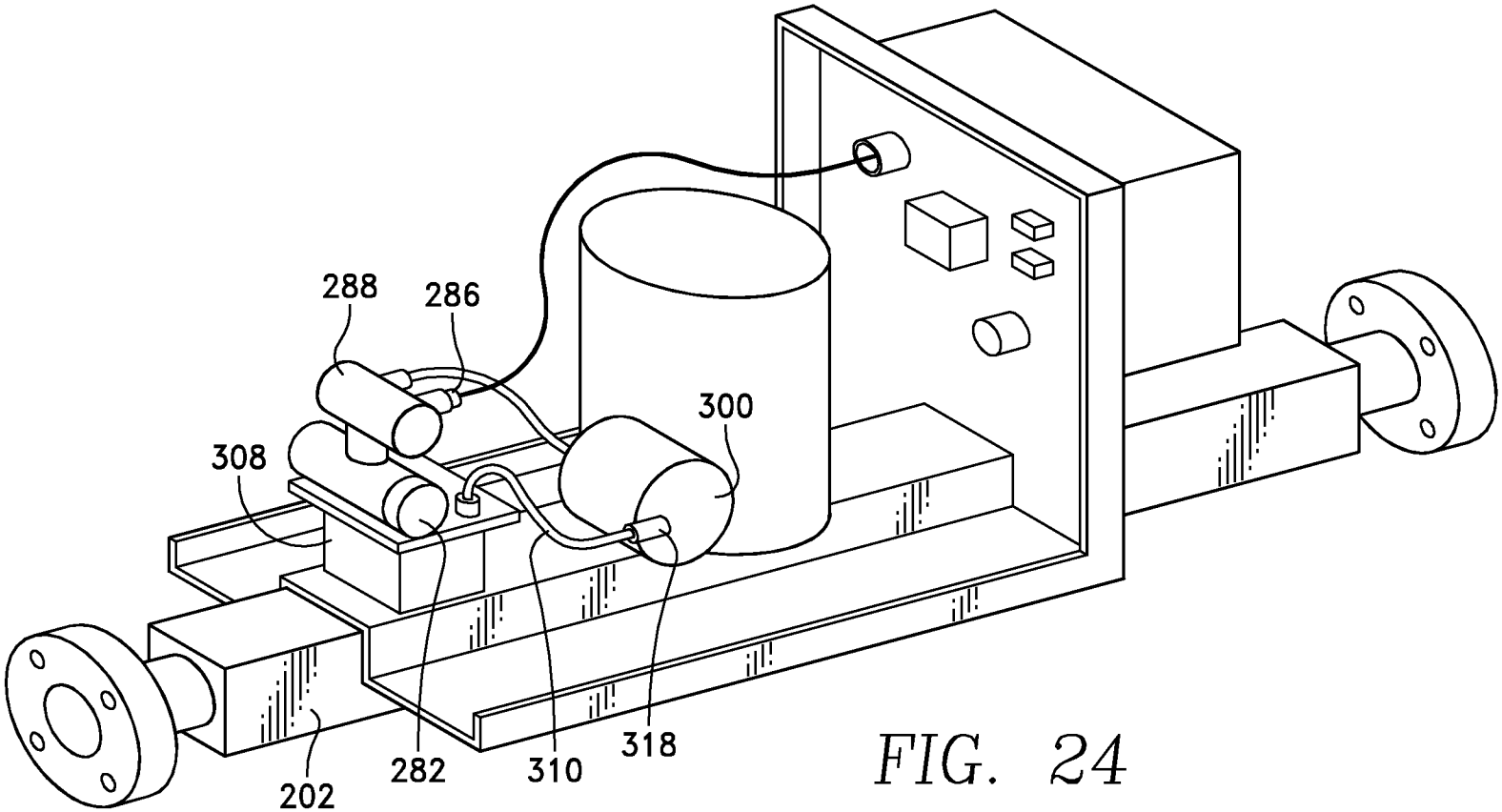
FIG. 24 shows the fluid level determination apparatus shown in FIG. 21 with the exterior cover removed.
Figure 25:
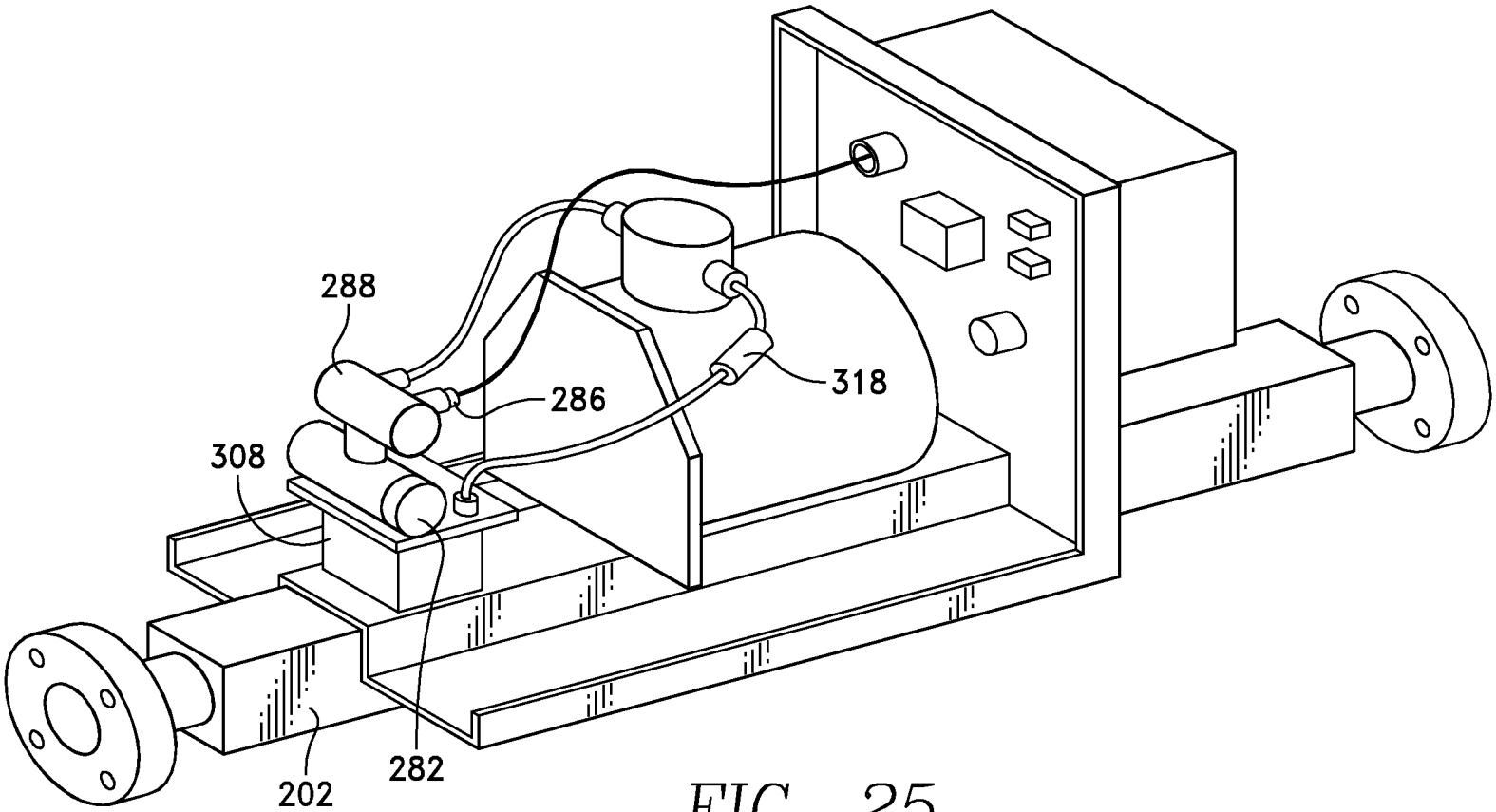
FIG. 25 shows an alternative embodiment of the fluid level determination apparatus with the exterior cover removed.
Figure 26:
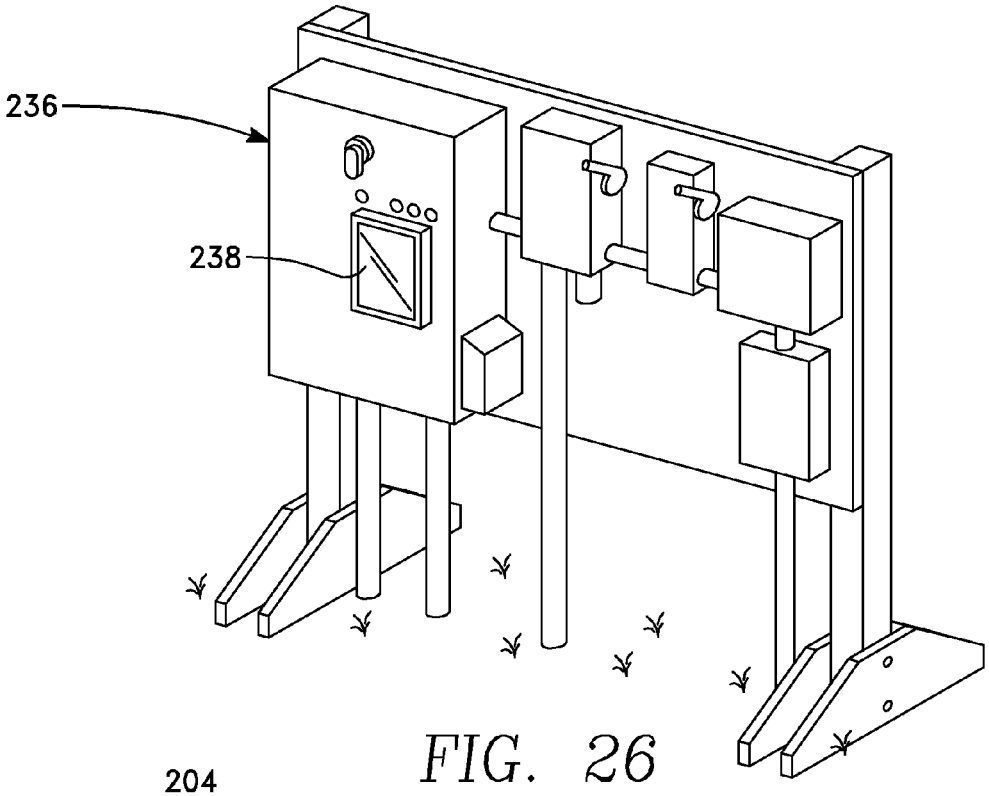
FIG. 26 shows motor controls which may be utilized in embodiments of the invention.
Figure 27:
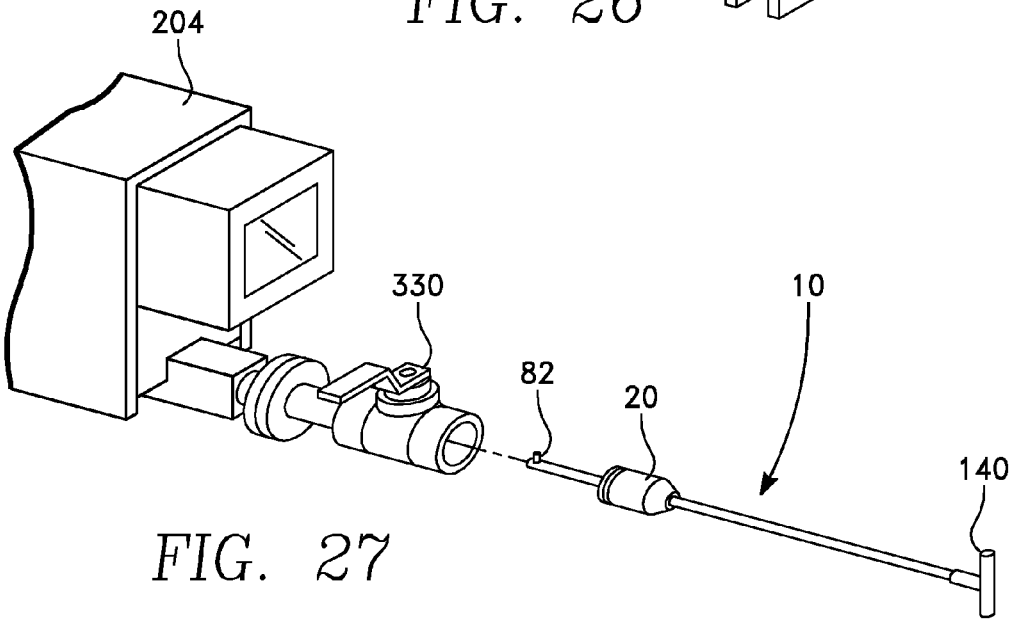
FIG. 27 shows the insertion of an installment tool into an embodiment of the apparatus.
Figure 28:
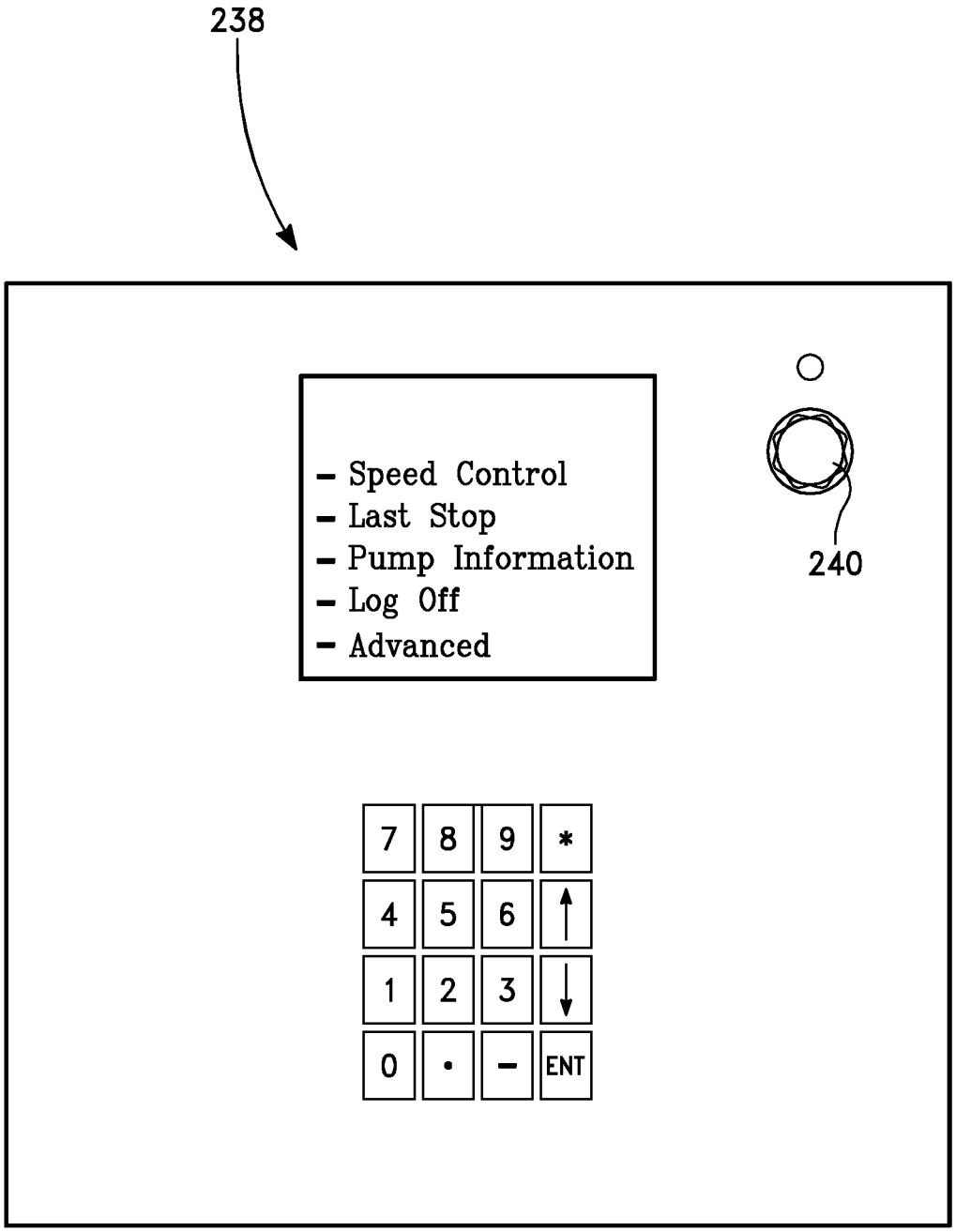
FIG. 28 shows a user interface for control of a variable frequency drive unit utilized with the present invention.

Typically located on the opposite side of the wellhead 258 from first outlet 290 is second outlet 306. Takeoff conduit 308 is attached to second outlet 306, wherein the takeoff conduit 308 may receive produced casing gas from annulus 276. A produced gas supply line 310 extends from the takeoff conduit 308. As schematically shown in FIG. 17, filter apparatus 318 may be utilized to filter produced casing gas received from produced gas supply line 310. Filter apparatus 318, which may be an inline filter, removes debris from the produced casing gas which would otherwise pass into compressor 300. Compressor 300 may be used to compress produced casing gas which flows from annulus 276. While FIG. 17 schematically shows the produced casing gas flowing through takeoff conduit 308, it is to be appreciated that alternative piping configurations may be utilized as known by those skilled in the art of the invention. FIGS. 24-25 provide perspective views of many of the components schematically depicted in FIGS. 16-17.

Block valve 320 is typically attached to second outlet 306 to control flow from the annulus 276, including regulating gas flow into takeoff conduit 308, and also allowing the well to be closed in. Block valve 320 is configure to permit insertion of the other components of the invention such as carrier tray 180, and portions of gas emission tubing 256 and gas receiving tubing 356 which are disposed within carrier member 250. These components are urged into a forward position by insertion tool shaft 60 such that gas injection port 382 at the terminus of gas emission tubing 256 and receiving port 402 at the terminus of gas receiving tubing 356 are positioned to face downward into annulus 276.

The gas emission tubing 256 passes through first channel 224 in locking mechanism 210, disposed at the end of the carrier tray 180, and into opening 232. Compressed gas from the gas emission tubing 256 may exit from gas injection port 382 and into the well annulus 276. Likewise, gas receiving tubing 356 extends through one of the openings in locking mechanism 210 such that produced gas received through receiving port 402 may flow through gas receiving tubing 356, which is in fluid communication with a pressure measurement device 500, such as a pressure transducer, accelerometer, or other means for detecting and measuring a pressure wave.

As discussed above, the gas injection port 382 and the sound wave receiving port 402 are positioned in the wellhead such that they are facing downward into annulus 276 between casing 260 and tubing 270. The advantage of having the gas injection port 382 and the sound wave receiving port 402 aimed directly downhole is to minimize any noise, disturbance or impeded flow which would otherwise occur by injecting the gas from any other location.

As schematically depicted in FIG. 16, an additional block valve 330 is located at the opposite end of the takeoff conduit 308. An additional piping segment 340 may be attached to block valve 330, where the piping segment has a threads 344, which may have a standard well cap attached (not shown).

Figure 20:
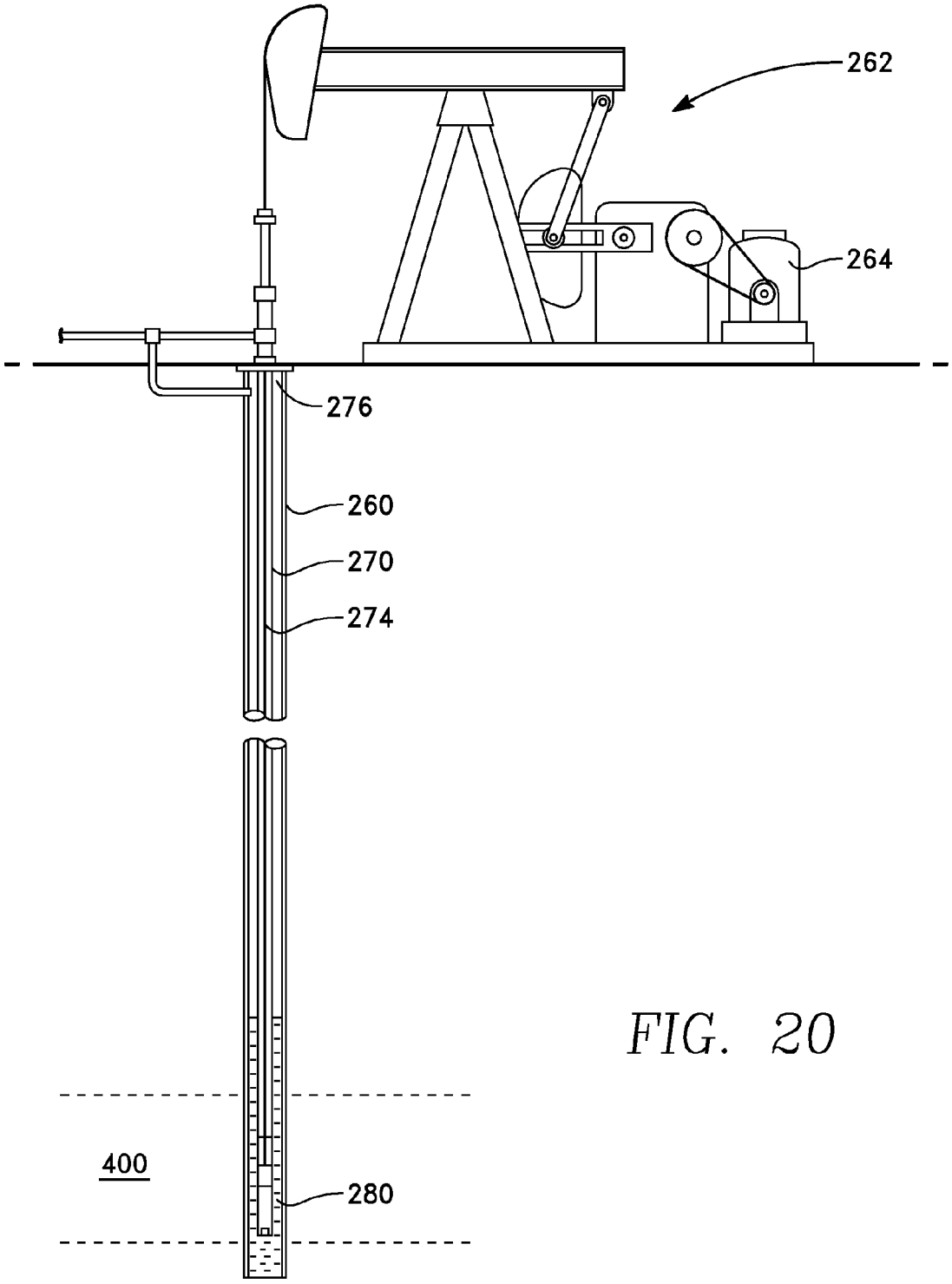
FIG. 20 schematically shows one form of artificial lift system which utilizes a surface pumping unit to operate a subsurface pump using reciprocation of a sucker rod string within a tubing string.

In operation, a subsurface pump 280 is utilized to artificially lift reservoir fluids produced from reservoir 282. The subsurface pump 280 is typically actuated by rod string 274 which is disposed within tubing 270. The rod string 274 may operate subsurface pump 280 by reciprocation. When operated by reciprocation, the rod string 274 is connected to a pump plunger and actuates the plunger upwardly and downwardly by the action of a surface pumping unit 262, such as that depicted in FIG. 20, and pumps fluid into tubing 270. Alternatively, the rod string 274 may be rotated by a surface unit such as that shown in FIG. 21 thereby actuating a progressive cavity pump 278 by rotating a rotor within a stator.

Positioning of the Fluid Level Determination Mechanism

To correctly position the equipment of the present invention the insertion tool 10 is assembled as shown in FIG. 1. If present, any cap or other fitting attached to threads 344 of additional piping segment 340 is removed. Threads on bell 20 of insertion tool 10 are then made up to the threads 344 of the additional piping segment 340. The insertion tool shaft 60 may then be inserted through the block valve 330.

As shown in FIGS. 16 and 17, the carrier member 250 carries and protects the length of the emission tubing 256 as it extends from the compressor valve 282 on one end to the other end attached to the gas injection port 382. Likewise, the carrier member protects the length of the gas receiving tubing 356 as it extends from pressure measurement device 500 to the sound wave receiving port 402. As suggested by FIGS. 15 and 16, emission tubing 256 and gas receiving tubing 356 must be sufficiently flexible to be manipulated forward such that the portion of the carrier tray 180 having gas injection port 382 and sound wave receiving port 402 may pass through the opened block valve 320 and be positioned within wellhead 258 with the gas injection port and sound wave receiving port oriented to be facing downwardly within annulus 276.

After being inserted through the block valve 330, the insertion tool shaft 60 is attached to the carrier tray 180 by passing through first channel 194 and making contact with the back wall of receiving piece 190. The insertion tool shaft 60 is then rotated 90 degrees such that projection 82 locks into second channel 198. Once the insertion shaft has locked onto the carrier tray 180, the insertion tool shaft 60 may be used to carrier tray forward to correctly position the gas injection port 382 and energy wave receiving port 402 as discussed above.

The insertion tool shaft 60 may then be disengaged by rotating the insertion tool shaft to disengage projection 82 from second channel 198. Once disengaged from carrier tray 180, insertion tool shaft 60 may be withdrawn through first channel 194 and through bell 20 to a point sufficient to permit the closing of block valve 330. Bell 20 may then be unscrewed from the threads 344 of additional pipe segment 340. The insertion tool 10 may be utilized for several wells rather than having a single insertion tool 10 permanently connected to each well. For the servicing or removal of the components, the entire operation may be reversed. That is, the insertion tool 10 is connected to the wellhead additional pipe 340 and the block valve 330 is opened. The insertion tool shaft 60 is then engaged to the receiving piece 190 and the carrier member 180 is then drawn in the direction of the additional pipe segment 340 such that the carrier member 180 clears block valve 320 and the block valve is closed.

Balancing Reservoir Inflow with the Outflow of the Artificial Lift Equipment

The apparatus described above provides a reliable and relatively inexpensive means of acquiring real time fluid level information for a particular well 502. When a number of wells 502, 504, 506, 508 producing from a single reservoir 400 are equipped with the apparatus, key information for reservoir management becomes available. This information allows reservoir engineers to make informed decisions regarding, among other things, pressure maintenance utilizing injection wells 510, infill well requirements, isolation of water zones, and target zones for increased injection. This information is also helpful to production engineers, allowing them, among other things, to properly size artificial lift equipment for a particular well, producing zone, or field and to optimize the production facilities according to the demands of the fluid output from the wells. One means of optimizing the artificial lift equipment is by utilizing motor control means on the prime mover 264 utilized to operate the subsurface pump.

In a relatively simple application of motor control means, the prime mover 264 operating the subsurface pump can be stopped and started according to the observed real time fluid level. More complicated applications control the speed of the prime mover 264 so that the outflow capacity of the artificial lift equipment is in dynamic equilibrium with the observed reservoir inflow. In most situations, the desired equilibrium will occur when the fluid level is maintained at a relatively small distance above the subsurface pump 278, 280. The optimal fluid level above the subsurface pump 278, 280 will exert minimal back pressure against the face of the producing reservoir to increase the inflow of reservoir fluids, but at a level which is sufficiently high to prevent gas locking of the pump or fluid pound.

Figure 21:
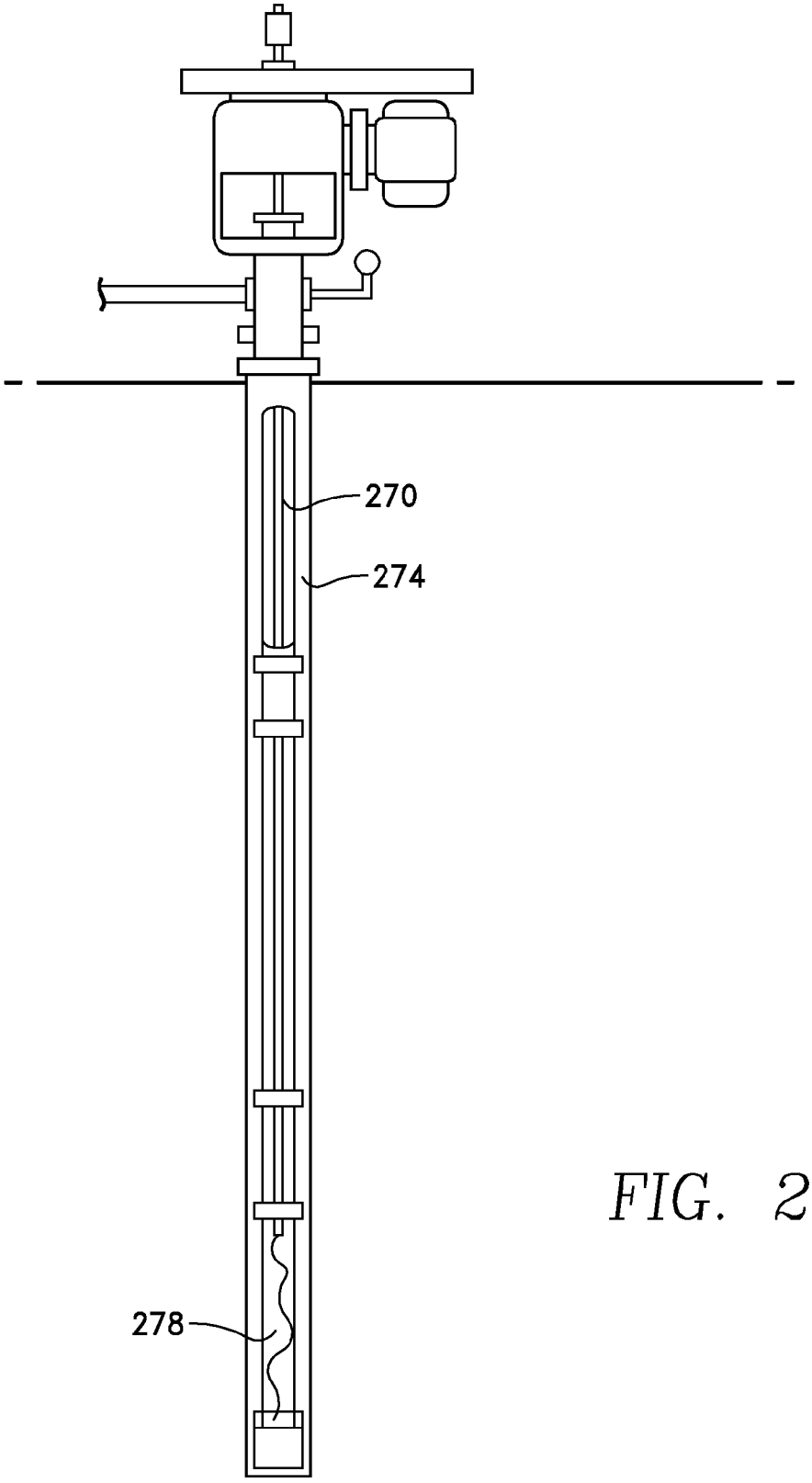
FIG. 21 schematically shows another form of artificial lift system which utilizes a surface unit to operate a progressive cavity pump using rotation of a sucker rod string within a tubing string.
Figure 22:
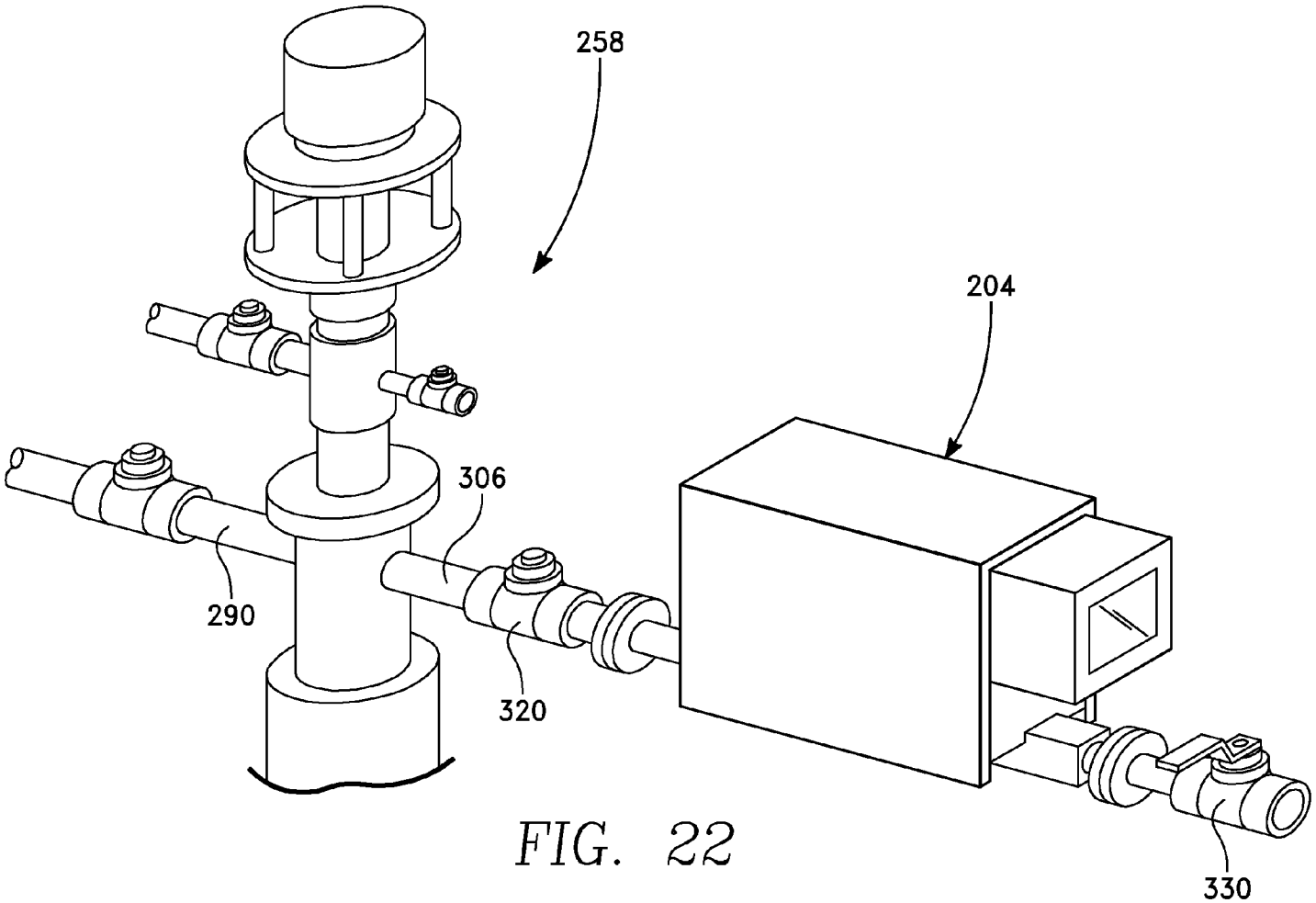
FIG. 22 shows an embodiment of the fluid level determination apparatus according to the present invention mounted to a wellhead.
Figure 23:
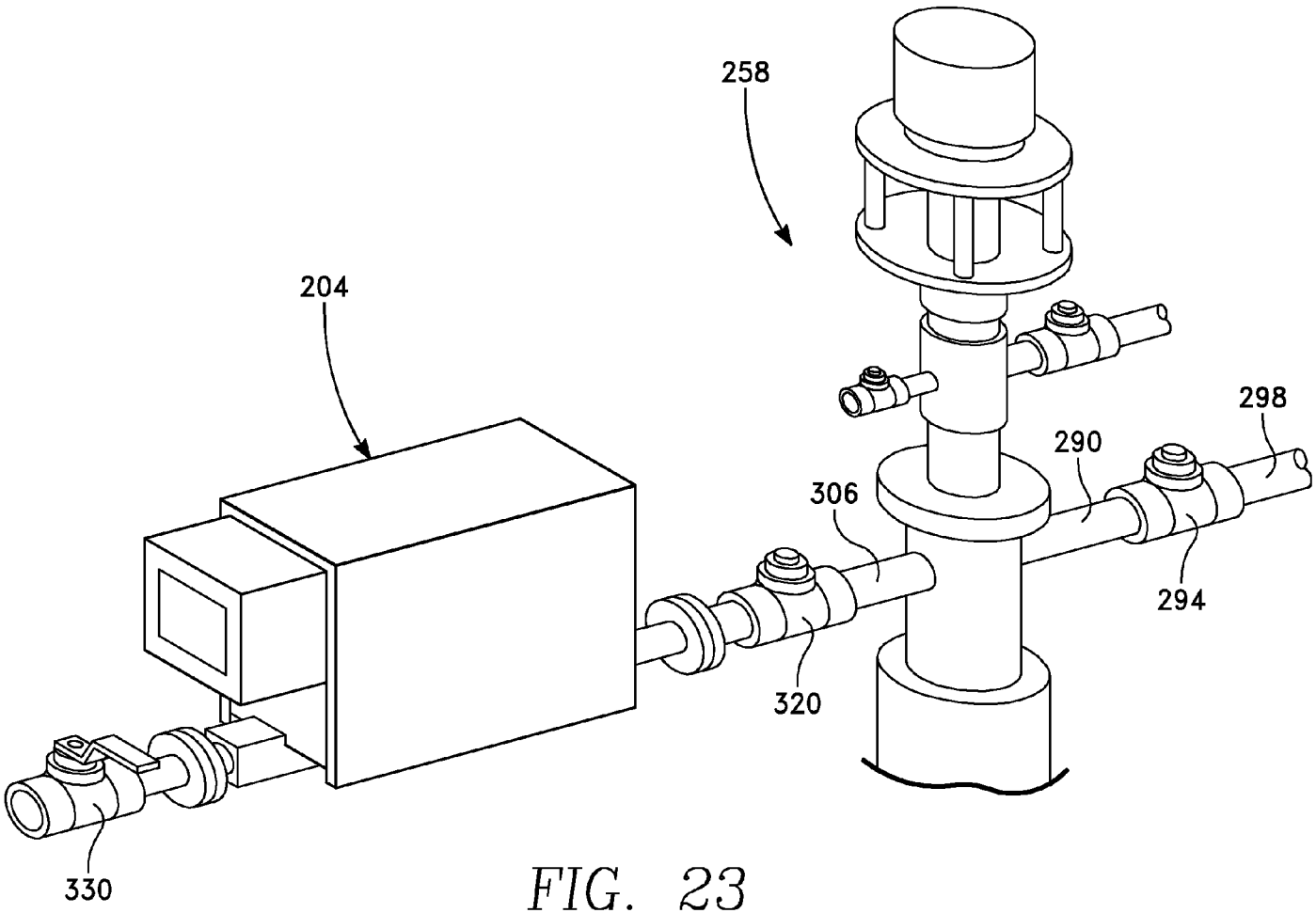
FIG. 23 shows the opposite side of the fluid level determination apparatus shown in FIG. 22.

For electrical motors, the most common method of controlling the speed of the motor is with a variable frequency drive unit ("VFD") 236, an example of which is shown in FIG. 25 as mounted as part of the motor controls for an electrical prime mover 264. On a rod pumped unit 286, such as that shown in FIG. 20, VFD 236 allows an operator to specify the exact speed for the motor to run, which typically ranges from 1200 RPM down to 240 RPM. The VFD 236 provides a number of known advantages to manually controlling the speed of the pumping unit 262 by stopping and starting the pumping unit or by changing the motor sheave size, which both require substantial dedications of manpower. Both manual control and time clock control require the pumping unit to be stopped, often for long periods of time, which can result in sand flow into the wellbore, and mechanical stresses when the unit is restarted. In contrast, the VFD 236 allows the pumping unit 262 to be run continuously which reduces mechanical stress on the pumping unit gearbox, rods, belts, etc. Slowing the speed of the pumping unit 262 reduces power consumption and demand factor. Similar advantages are present for using a VFD 236 with a progressive cavity pump system as depicted in FIG. 21.

However, the combination of real time fluid level determination with the speed control of a VFD 236 provides even greater advantages. The presently disclosed system combines the real time determination of the fluid level with means of near instantaneous control of the outflow of the artificial lift system, allowing the operator, by input into a control panel, to specify the desired fluid level to be maintained in a particular well. Data provided from the above described real time fluid level determination apparatus is provided to a processor controlling the VFD 236. The sampling rate of the real time fluid level determination apparatus may be adjusted to provide fluid level determinations as frequently as every twenty seconds. The fluid level determinations may be provided to a processor controlling the VFD 236. As result, the inflow and outflow performance of the well can be optimized for producing the well at a flow rate which is efficient, reduces wear in the artificial lift system, and which may be coordinated on a field wide basis with other artificial lift units for effective reservoir management.

The VFD may have a user interface 238 which allows the user to input a desired fluid level or to set the unit for a desired production rate. The user interface 238 may further comprise a rheostat control 240 which allows the operator to make immediate changes to the pumping speed in accord with the observed conditions. The user interface 238 may also be utilized to provide various reservoir management tools, such as historical analysis of fluid levels and production rates.

Figure 29:
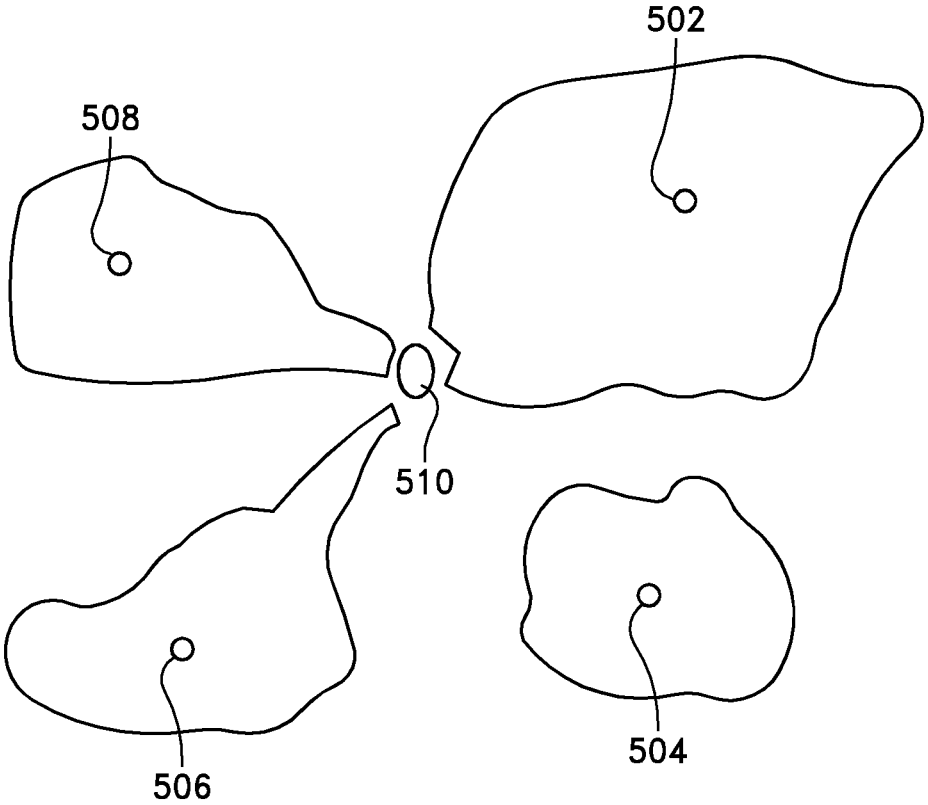
FIG. 29 schematically shows a plan view of a portion of an oil field which may utilize embodiments of the disclosed system for reservoir management.

When employed on a field wide basis, such as depicted in the example provided in FIG. 29, the data may be utilized to ascertain, among other things, the effectiveness of well stimulation programs, pressure maintenance activities, and well spacing practices. When analyzed together with well maintenance records, the information may also be utilized for analyzing preventative maintenance, scheduling pump changes, and well diagnostics.

While the above is a description of various embodiments of the present invention, further modifications may be employed without departing from the spirit and scope of the present invention. Thus the scope of the invention should not be limited according to these factors, but according to the following appended claims.

What is claimed is:

1. A system for producing fluids from a well, the well comprising a wellhead, a string of casing and a string of tubing concentrically disposed within the casing wherein an annulus is defined between an outside wall of the tubing and an inside wall of the casing, the system comprising:

a fluid level determination device, said device comprising a gas emission tubing having an outlet inserted into the annulus through which outlet a charge of compressed gas is released, a pressure wave receiving tube having an inlet inserted into the annulus through which inlet a pressure wave is detected, a pressure wave measurement device attached to the pressure wave receiving tube, said pressure wave measurement device producing an output signal upon detection of a pressure wave, and processing means which, upon receipt of the output signal, determines the depth to fluid in the annulus wherein the gas emission tubing and the pressure wave receiving tube and the pressure wave receiving tube are substantially disposed within a carrier tray;

a subsurface pump in the well for producing the fluids;

an electrical motor which operates the subsurface pump; and means for controlling the rotational speed of the electrical motor, said means for controlling the rotational speed of the motor adjustable according to the determined depth to fluid in the annulus.

2. The system of claim 1 wherein the outlet of the gas emission tubing is disposed in substantially downhole facing direction over the annulus.

3. The system of claim 1 wherein the inlet of the pressure wave receiving tube is disposed in substantially downhole facing direction over the annulus.

4. The system of claim 1 wherein said pressure wave measurement device is an accelerometer.

5. The system of claim 1 wherein the charge of compressed gas comprises a produced gas from the well.

6. The system of claim 1 wherein the carrier tray is substantially contained within a housing attached to the wellhead, the carrier tray comprising a first end and a second end.

7. The system of claim 6 wherein the carrier tray may be disposed within a plurality of positions within the housing ranging from an extended position wherein the first end is disposed immediately adjacent to the annulus to a retracted position wherein the first end is pulled back from the annulus.

8. The system of claim 7 wherein an insertion tool shaft may be removably attached to the carrier tray and utilized to either move the carrier tray from the retracted position to the extended position or from the extended position to the retracted position.

9. The system of claim 1 wherein a fluid level may be determined three times per minute.

10. In an oil well comprising a wellhead, a string of casing and a string of tubing concentrically disposed within the casing wherein an annulus is defined between the tubing and the casing, a system allowing the balancing of the reservoir inflow performance of a producing reservoir with the outflow performance of a subsurface pump while maintaining the fluid level within the annulus at a desired level comprises:

a fluid level determination device, said device comprising a gas emission tubing installed adjacent to the wellhead, the gas emission tubing having an outlet through which outlet a charge of compressed gas is released, a pressure wave receiving tube installed adjacent to the wellhead, the receiving tube having an inlet through which a pressure wave is detected, a pressure wave measurement device attached to the pressure wave receiving tube, said pressure wave measurement device producing an output signal upon detection of a pressure wave, and processing means which, upon receipt of the output signal, determines the depth to fluid in the annulus;

a carrier tray into which the gas emission tubing and the pressure wave receiving tube are substantially disposed;

an electrical motor which operates the subsurface pump; and means for controlling the rotational speed of the electrical motor, said means for controlling the rotational speed of the motor adjustable according to the desired fluid level.

11. The system of claim 10 wherein the outlet of the gas emission tubing is disposed in substantially downhole facing direction over the annulus.

12. The system of claim 10 wherein the inlet of the receiving tubing is disposed in substantially downhole facing direction over the annulus.

13. The system of claim 10 wherein said pressure wave measurement device is an accelerometer.

14. The system of claim 10 wherein the charge of compressed gas comprises a produced gas from the well.

15. The system of claim 10 wherein the carrier tray is substantially contained within a housing attached to the wellhead, the carrier tray comprising a first end and a second end.

16. The system of claim 15 wherein the carrier tray may be disposed within a plurality of positions within the housing ranging from an extended position wherein the first end is disposed immediately adjacent to the annulus to a retracted position wherein the first end is pulled back from the annulus.

17. The system of claim 16 wherein an insertion tool shaft may be removably attached to the carrier tray and utilized to either move the carrier tray from the retracted position to the extended position or from the extended position to the retracted position.

18. In an oil field comprising at least a first oil producing well and a second oil producing well producing from the same oil reservoir, each well comprising a wellhead, a string of casing and a string of tubing concentrically disposed within the casing wherein an annulus is defined between an outside wall of the tubing and an inside wall of the casing, a system provides real time fluid level determinations within the annulus of each well and allows the fluid level within each oil well to be maintained at a desired distance above a subsurface pump within each well, the system comprising:

a fluid level determination device installed in both the first oil producing well and the second producing well, said fluid level determination device comprising a gas emission tubing inserted into the annulus of each oil producing well, the gas emission tubing having an outlet through which outlet a charge of compressed gas is released, a pressure wave receiving tube installed inserted into the annulus of each oil producing well wherein the gas emission tubing and the pressure wave receiving tube and the pressure wave receiving tube are substantially disposed within a carrier tray, the pressure wave receiving tube having an inlet through which a pressure wave is detected, a pressure wave measurement device attached to the pressure wave receiving tube of each oil producing well, said pressure wave measurement device producing an output signal upon detection of a pressure wave, and processing means which, upon receipt of the output signal, determines the depth to fluid in the annulus in each well;

an electrical motor which operates the subsurface pump in each oil producing well; and means for controlling the rotational speed of each electrical motor, said means for controlling the rotational speed of each motor adjustable according to the desired fluid level in each well.

* * * * *